US005823817A

United States Patent [19]

Pyle

[11] Patent Number: 5,823,817

[45] Date of Patent: Oct. 20, 1998

[54] CORD GUARD

[75] Inventor: Michael L. Pyle, Mechanicsville, Va.

[73] Assignee: Hamilton Beach/Proctor-Silex, Inc., Glen Allen, Va.

[21] Appl. No.: 736,445

[22] Filed: Oct. 24, 1996

[51] Int. Cl.[6] ..... H01R 13/56

[52] U.S. Cl. ..... 439/447; 439/448

[58] Field of Search ..... 439/445–448

[56] References Cited

U.S. PATENT DOCUMENTS

| | | | |
|---|---|---|---|
| D. 210,021 | 1/1968 | Prifogie et al. | D26/1 |
| D. 241,008 | 8/1976 | Di Loreto | D8/8 |
| D. 294,486 | 3/1988 | Opitz | D13/24 |
| D. 314,458 | 2/1991 | Littmann | D32/70 |
| D. 326,257 | 5/1992 | Lee et al. | D13/129 |
| D. 340,329 | 10/1993 | Barrault | D32/70 |
| D. 349,378 | 8/1994 | Simmon | D32/70 |
| D. 360,875 | 8/1995 | Nakajima | D13/156 |
| D. 363,580 | 10/1995 | Wilson et al. | D32/70 |
| 1,043,864 | 11/1912 | Pollard . | |
| 1,177,307 | 3/1916 | Craven . | |
| 1,920,553 | 8/1933 | Fossati | 439/447 |
| 2,022,785 | 12/1935 | Rollman | 439/447 |
| 2,035,345 | 3/1936 | Schaefer | 439/447 |
| 2,286,487 | 6/1942 | Huffman | 219/25 |
| 2,540,575 | 2/1951 | Finizie | 173/332 |
| 2,724,736 | 11/1955 | Klumpp, Jr. | 174/153 |
| 2,727,088 | 12/1955 | La Wall | 439/447 |
| 2,774,948 | 12/1956 | Wendel | 439/447 |
| 3,032,737 | 5/1962 | Rottmann | 339/101 |
| 3,051,774 | 8/1962 | Schelke | 174/135 |
| 3,395,244 | 7/1968 | Koehler | 439/448 |
| 3,449,706 | 6/1969 | Carissimi | 339/94 |
| 3,497,608 | 2/1970 | Elliot et al. | 174/135 |
| 3,665,374 | 5/1972 | Denton | 439/447 |
| 3,721,939 | 3/1973 | Paugh | 339/14 R |
| 3,800,068 | 3/1974 | Torgerson | 174/135 |
| 3,986,765 | 10/1976 | Shaffer et al. | 339/90 R |
| 4,173,384 | 11/1979 | Phillips | 339/101 |

(List continued on next page.)

FOREIGN PATENT DOCUMENTS

| | | | |
|---|---|---|---|
| 0537932 | 11/1931 | Germany | 439/448 |
| 2091498 | 7/1982 | United Kingdom | 439/447 |

OTHER PUBLICATIONS

Commonly–owned design patent application 29/060,410, filed Sep. 27, 1996.

Commonly–owned design patent application 29/060,416, filed Sep. 27, 1996.

Front cover and pp. 34–35 of "Heyco Catalog 191" published by Heyco Molded Products, Inc., Kenilworth, NJ, admitted to be prior art (No Date).

Drawing prepared for purposes of this Information Disclosure Statement showing cross–sectional shape of prior art cord guard illustrated in "Heyco Catalog 191" published by Heyco Molded Products, Inc. (No Date).

Front cover, rear cover, and pp. 3–5 of "Spring 1993 New Products" catalog published by Hamilton Beach/Proctor–Silex, Inc., Glen Allen, VA, 1993.

Three photographs prepared for purposes of this Information Disclosure Statement showing a prior art cord guard.

*Primary Examiner*—Neil Abrams
*Assistant Examiner*—Katrina Davis
*Attorney, Agent, or Firm*—Roger S. Dybvig

[57] ABSTRACT

A cord guard for an electrical power supply cord, such as the power cord of an electric pressing iron, includes a flexible strain relief sleeve having a central passageway therethrough and an outwardly-flared bell at one end of the strain relief sleeve open to the central passageway. The central passageway is adapted to snugly receive an electrical power supply cord along the entire length of the passageway. To this end, the passageway is formed with minimal draft. The strain relief sleeve may be formed by a tubular body having a plurality of parallel, equally spaced, V-shaped grooves extending circumferentially therearound, or the strain relief sleeve may be formed by an open spiral body having a uniform outside diameter along its length. The cord guard permits bending through at least 180 degrees without kinking the power cord, prevents twisting of the power cord within the cord guard, and reduces stress on the power cord at the point at which it exits the cord guard.

26 Claims, 2 Drawing Sheets

U.S. PATENT DOCUMENTS

| | | | |
|---|---|---|---|
| 4,632,488 | 12/1986 | Long et al. | 339/103 R |
| 4,702,710 | 10/1987 | Dittman et al. | 439/271 |
| 4,703,989 | 11/1987 | Price et al. | 439/283 |
| 4,989,581 | 2/1991 | Tambarrino et al. | 128/4 |
| 5,100,341 | 3/1992 | Czyz et al. | 439/447 |
| 5,170,016 | 12/1992 | Liu et al. | 174/138 R |
| 5,224,874 | 7/1993 | Sell | 439/448 |
| 5,238,419 | 8/1993 | Roeder et al. | 439/164 |
| 5,283,393 | 2/1994 | Guginsky | 174/102 R |
| 5,340,330 | 8/1994 | Dolson et al. | 439/445 |
| 5,390,433 | 2/1995 | Brady | 38/79 |

CORD GUARD

FIELD OF THE INVENTION

This invention relates to cord guards for electrical power supply cords, particularly for use with household electric appliances such as pressing irons.

BACKGROUND OF THE INVENTION

A typical household electric appliance, such as a pressing iron, is powered by electric current supplied through an electrical power supply cord connected to a wall outlet. The power cord of a pressing iron, for example, is susceptible to damage or failure from undue stress placed on the power cord near its point of connection to the iron. Typically, such undue stress is the result of repeated bending and kinking of the power cord as it is coiled around the iron for storage.

To reduce the likelihood of power cord damage or failure due to kinking, a strain relief member, commonly termed a cord guard, is provided around the power cord at its point of connection to the iron. The cord guard restricts and controls the bending of the power cord to protect or guard it from failure due to repeated bending stresses placed on the power cord. Many different cord guard constructions have been used with pressing irons, but previous cord guard constructions have several disadvantages.

The known prior cord guards often permit the power cord therein to kink when bent through an angle of about ninety degrees or more. This kinking creates an undesirable point of high stress on the power cord. In addition, the use of previously-known cord guards may lead to a failure in the power cord at or just beyond the end of the cord guard due to the engagement between the power cord and the outer end of the cord guard. In some cases, the power cord may also fail at a point within the cord guard due to repeated twisting of the power cord about its axis.

SUMMARY OF THE INVENTION

An object of this invention is to provide an improved cord guard for an electrical power supply cord that permits the cord guard and power cord it protects to be bent through an angle of at least ninety, and preferably 180, degrees without kinking the power cord or otherwise placing undue stress on the power cord.

A further object of this invention is to provide a cord guard wherein a power cord extending therethrough is not permitted to twist within the cord guard.

Another object of this invention is to provide a cord guard wherein no undue stress is placed on the power cord at or near the point at which it exits the cord guard.

Still another object of this invention is to provide a cord guard in accordance with the foregoing objects that is durable, relatively inexpensively and easily manufactured, aesthetically pleasing, and easily adapted for use with existing electric pressing irons.

In accordance with this invention, a cord guard includes a flexible strain relief sleeve having a central passageway therethrough and an outwardly-flared bell at one end of the strain relief sleeve open to the central passageway. The central passageway, which receives an insulated power supply cord, has a substantially uniform transverse cross-sectional size and shape along its length, i.e. minimal draft, and has substantially the same transverse cross-sectional size and shape as the electrical power supply cord. As a result, the power supply cord fits snugly within the strain relief sleeve along its entire length. In a preferred embodiment, the strain relief sleeve comprises a tubular body that has a plurality of parallel, equally-spaced V-shaped grooves extending circumferentially therearound. In an alterative embodiment, the strain relief sleeve comprises an open spiral body having a uniform outside diameter along its length, and the central passageway for the power cord is formed by radially-inwardly facing surfaces of the spiral body.

The central passageway in the strain relief sleeve is generally oval or elliptical in transverse cross-section to substantially conform to the cross-sectional shape of typical two-wire, ribbon-like, insulated electrical power supply cords. The bell, which is preferably integrally formed with the strain relief sleeve, flares to a greater extent along an axis parallel to the minor transverse axis of the strain relief sleeve than along an axis parallel to the major transverse axis of the strain relief sleeve.

The close conformity of the central passageway to the power cord provided by the minimal draft of the passageway cooperates with the configuration of the body of the strain relief sleeve, either spiral or grooved, to prevent kinking and twisting of the power cord within the strain relief sleeve. The bell at the end of the strain relief sleeve serves to reduce stress on the power cord at the point at which it exits the cord guard.

Cord guards in accordance with this invention are useful with pressing irons in which the power cords are generally fixedly attached to the irons as well as with pressing irons having pivotable cord guards, such as disclosed in U.S. Pat. No. 5,390,433. In addition, cord guards in accordance with this invention may also be useful with household electric appliances other than pressing irons or with other non-household appliances.

Other objects and advantages of this invention will become apparent from the following description in conjunction with the accompanying drawings.

DETAILED DESCRIPTION

Figure 1:
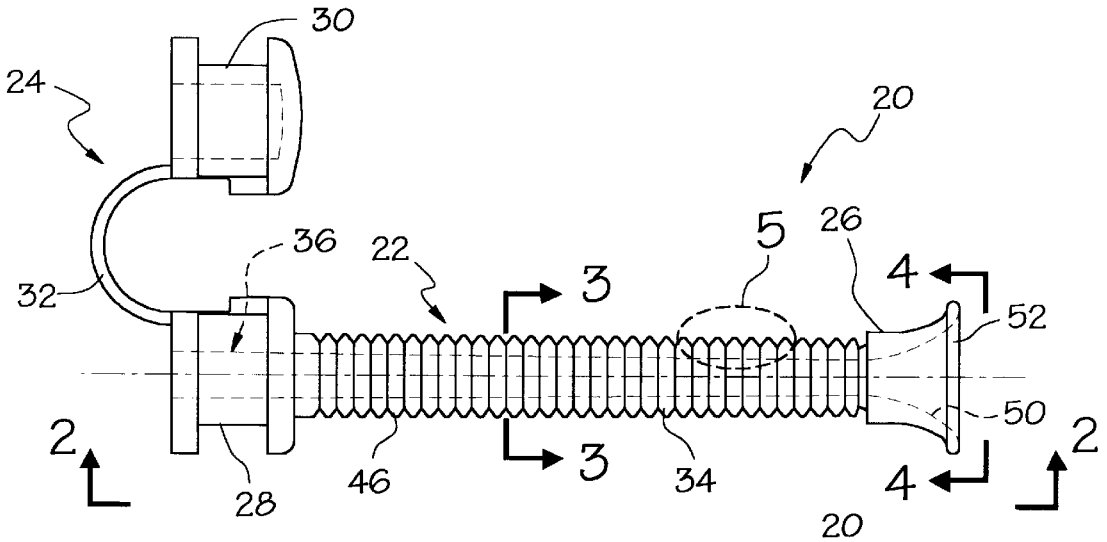
FIG. 1 is an elevational view of a preferred embodiment of a cord guard in accordance with this invention. For convenience, the portion of the cord guard shown in FIG. 1 is referred to as the side.
Figure 2:
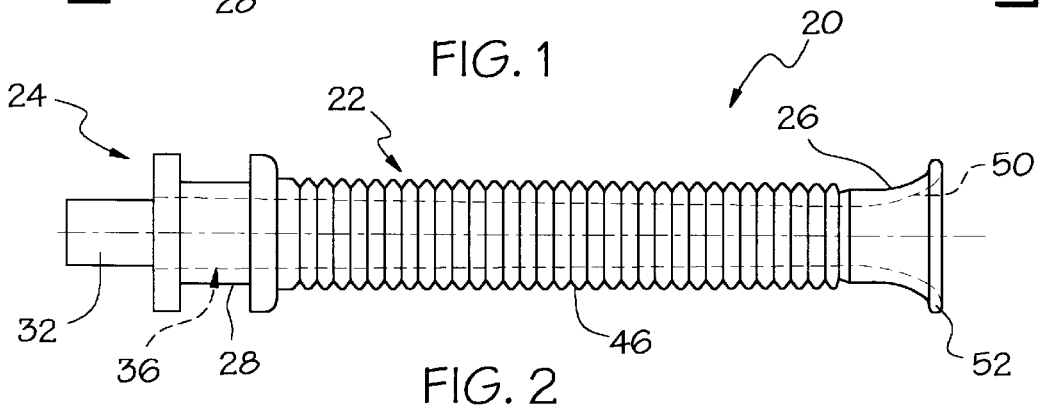
FIG. 2 is a plan view of the cord guard of FIG. 1 looking in the direction of arrows 2—2 of FIG. 1. For convenience, the portion of the cord guard shown in FIG. 2 is referred to as the bottom.

FIGS. 1 through 5 illustrate the preferred embodiment of a cord guard in accordance with this invention, generally designated 20. With particular reference to FIGS. 1 and 2, the cord guard 20 generally comprises an elongated strain relief sleeve, generally designated 22, a conventional cord set connector, generally designated 24, at the proximal end of the strain relief sleeve 22, and a bell 26 at the distal end of the strain relief sleeve 22. The conventional cord set connector 24 comprises a cord connector 28 linked to a dummy connector 30 by a strap 32. As well known in the art, the cord set connector 24 permits an electrical power supply cord to be extended from either the right side or the left side of a conventional pressing iron (not shown), depending upon the preference of the user.

Figure 3:
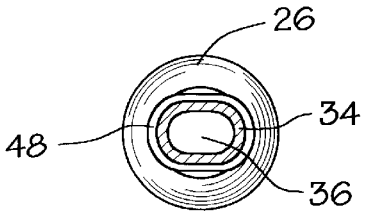
FIG. 3 is a transverse sectional view of the cord guard of FIG. 1 taken along line 3—3 thereof.
Figure 4:
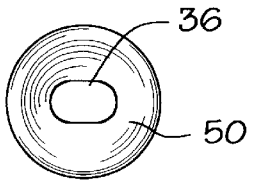
FIG. 4 is an end view of the cord guard of FIG. 1 looking in the direction of arrows 4—4 thereof.

With reference also to FIGS. 3 and 4, the strain relief sleeve 22 comprises a tubular body 34 integrally formed with the cord set connector 24 and the bell 26, all in one piece, using known injection molding techniques. A central passageway 36 extends through the cord connector 28 and the tubular body 34 opening to the bell 26. For reasons which will be described below, the central passageway 36 is formed to closely conform to the outside of the portion of an electrical power supply cord extending therethrough. To this end, the central passageway 36 is formed to have minimal draft along its length, as will be described below. The minimal draft of the central passageway 36 and the resulting close conformity between the central passageway 36 and the outside of the power cord prevent the power cord from being twisted within the strain relief sleeve 22 when, for example, the user of the iron coils the power cord around the iron for storage.

Figure 6:
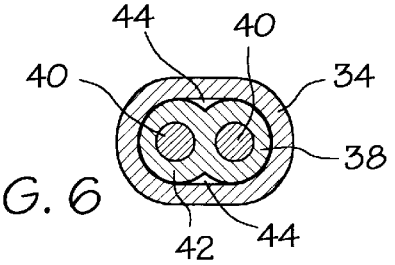
FIG. 6 is an enlarged view of a portion of FIG. 3 also showing a typical two-wire, insulated electrical power supply cord within the cord guard.
Figure 7:
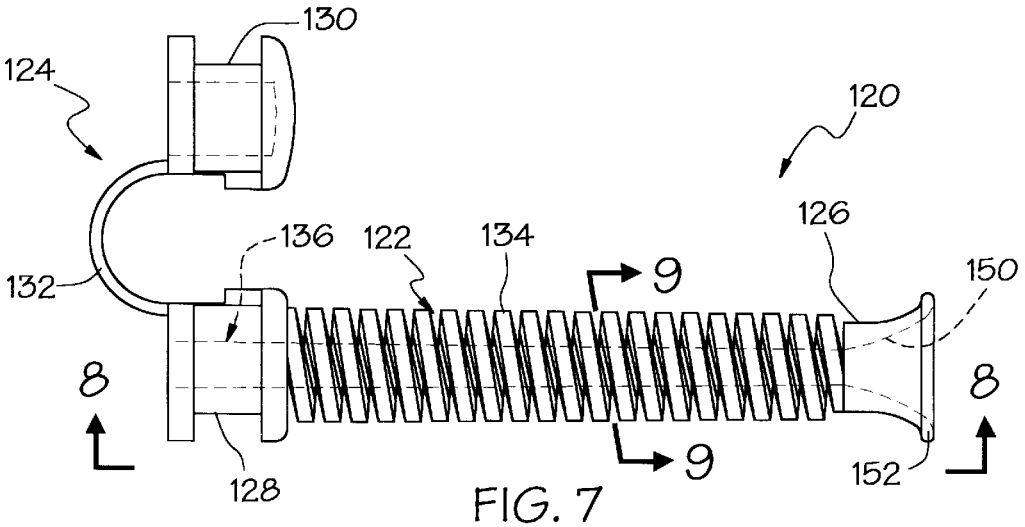
FIG. 7 is an elevational view of a second embodiment of a cord guard in accordance with this invention. For convenience, the portion of the cord guard shown in FIG. 7 is referred to as the side.
Figure 8:
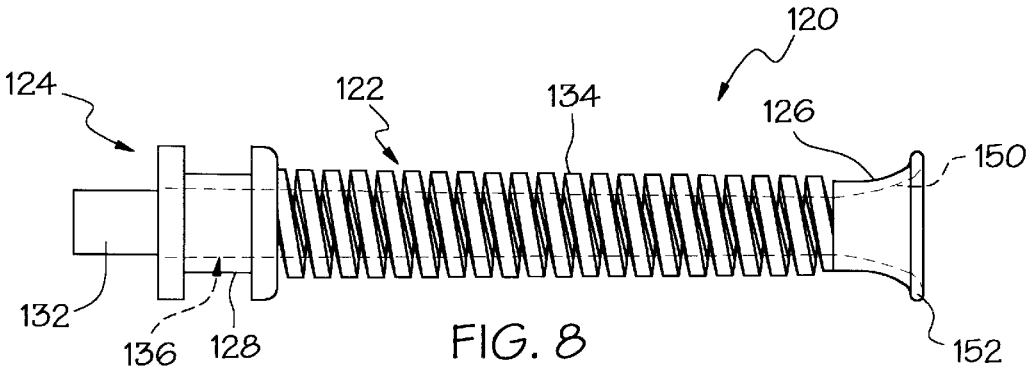
FIG. 8 is a plan view of the cord guard of FIG. 7 looking in the direction of arrows 8—8 of FIG. 7. For convenience, the portion of the cord guard shown in FIG. 8 is referred to as the bottom.

Although it may be preferable that the transverse cross-section of the central passageway 36 conform exactly in size and shape to the transverse cross-section of the power cord, substantial conformity in size and shape has been found to be acceptable to prevent kinking and twisting. FIG. 6 illustrates a typical insulated electrical power supply cord 38 for an electric pressing iron received in the central passageway 36. Although other cord configurations may be used, the power cords 38 for electric irons typically comprises a pair of electrical conductors 40 encased in an insulating material 42. In transverse cross-section, as shown in FIG. 6, the power cord 38 is generally in the shape of a "figure eight". However, the shape may be generally characterized as oval or elliptical with the small spaces 44 formed between the power cord 38 and the wall forming the central passageway 36 being disregarded for purposes of this invention.

With particular reference to FIGS. 3 and 4, the central passageway 36 is, in transverse cross-section, generally oval or elliptical to conform to the general shape of the power cord 38. This close conformity is evident from FIG. 6. As mentioned above and as will be described below in detail, the central passageway 36 is formed with minimal draft so that the passageway has a substantially uniform transverse cross-sectional shape and size along its length.

Figure 5:
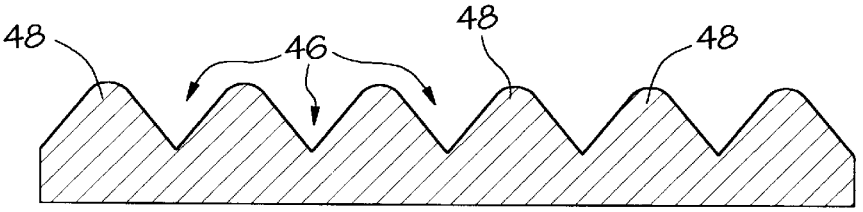
FIG. 5 is an enlarged, fragmentary sectional view of the cord guard of FIG. 1 showing, in detail, the portion of the cord guard enclosed in the broken-line circle 5 thereof.

Referring to FIGS. 1, 2 and 5, the tubular body 34 has a plurality of mutually-parallel, equally-spaced, V-shaped grooves 46 extending around the circumference thereof. The grooves 46 cooperate with the power cord 38 to prevent kinking of the power cord when the cord guard 20 and the cord 38 are bent through an extreme angle of 90 to 180 degrees or more. Kinking is prevented because the power cord 38, when bent, forces contraction or expansion of the grooves 46, as will be described below. When compared to prior known cord guards, a longer bend radius in the power cord 38 is created, which distributes bending stress across a longer section of the cord 38.

With particular reference to FIG. 5, the ridges 48 between the grooves 46 have rounded peaks, and the horizontal distance from valley to peak is equal to the height of the peaks. As a result, the mutually-confronting walls of the V-shaped grooves 46 extend outwardly from valley to peak at an angle somewhat less than 45 degrees from vertical. Of course, other ratios between the peak spacing and the peak height could be used.

As the cord guard 20 is bent upon itself, the grooves 46 are either collapsed or expanded, depending on the direction of the bend. As the grooves 46 collapse, adjacent ridges 48 associated with the collapsing grooves 46 begin to engage one another. This engagement between the ridges 48 prevents sharp bends in the strain relief sleeve 22, which results in a longer bend radius than achieved by prior known cord guards. Accordingly, the bending stress is distributed over a larger surface area of the power cord 38.

Referring to FIGS. 1 through 4, the bell 26 at the distal end of the strain relief sleeve is provided to reduce stress on the power cord 38 at the point at which it exits the cord guard The bell 26 creates a gradual bend in the power cord 38 by permitting the cord 38 to be drawn across the outwardly-flared inner bell surface 50. In addition, the bell has a rolled flange 52 at its outer end which also serves to reduces stress on the power cord 38.

The bell 26 flares outwardly at different rates around its circumference in relation to the shape of the central passageway 36. The central passageway 36, being generally elliptical, has both a major transverse axis and a minor transverse axis, and as evident from a comparison of FIGS. 1 and 2, the bell 26 flares to a greater extent along its axis parallel to the minor axis of the central passageway 36 than along its axis parallel to the major axis of the central passageway 36. Because the cord guard 20 is more easily bent about the major transverse axis of the central passageway 36 than about the minor transverse axis of the central passageway 36, the particular flaring of the bell 26 permits an even more gradual bend in the power cord 38 in the direction that it will most likely be bent.

The cord set connector 24, the strain relief sleeve 22, and the bell 26 are preferably molded as a unitary structure from an injection molding grade flexible vinyl alloy having a durometer hardness of 85+5. A polyvinyl chloride (PVC) compound sold under the product name VP-031D-80A by Viking Polymers, LLC, 118 Wade Street, P.O. Box 577, Jamestown, N.C. 27282, is presently preferred. Other suitable PVC compounds, thermoplastic elastomer (TPE) materials, or any other suitable material may also be used. The cord guard 20 may be molded using suitable known injection molding techniques that permit the minimal draft of the central passageway 36 described above.

With regard to the injection molding equipment used to form the cord guard 20, one skilled in the art will be familiar with injection molding machines that utilize laterally-moving slides in addition to the conventional mating mold parts, such slides moving one or more core parts as the mold is opened or closed. Here, it is preferable to use dual slides that provide a slight positive draft or taper in the central passageway in both directions from the center or near the center of the central passageway 36 toward each end. In other words, it is preferable to provide a slight negative draft from each end of the central passageway 36 toward the center of the central passageway 36. A negative 0.5 degree draft from each end toward the center of the central passageway 36 has been found to be acceptable, although an even smaller draft would be preferred if practical.

The use of dual slides providing negative draft from one end toward the center of the central passageway 36 and positive draft from the center toward the opposite end of the central passageway 36 allows for a substantially uniform inside diameter of the central passageway 36 along its length. Although some variation in the diameter along the central passageway 36 will be present due to molding requirements, the change in diameter is nominal because the use of dual slides permits the magnitude of the draft to be reduced. One skilled in the art will recognize that absolute uniformity of the diameter of the central passageway 36 along its length, although preferred, is practically impossible due to present molding requirements.

FIGS. 7 through 12 illustrate a second embodiment of a cord guard in accordance with this invention, generally designated 120. The cord guard 120 is similar to the cord guard 20 in many aspects. In fact, apart from the configuration of the strain relief sleeve 122 of the cord guard 120, the cord guard 120 may be substantially identical to the cord guard 20. Therefore, like parts, such as the cord set connector and the bell, are given like reference numbers increased by 100 and are not described further herein. For example, the cord set connector 24 of the first embodiment corresponds to the cord set connector 124 of the second embodiment, and so on.

The body 134 of the sleeve 122 is in the form of an open spiral having a uniform outside diameter along its length. As with the tubular body 34 of the preferred embodiment, the spiral body 134 of the embodiment of FIGS. 7 through 11 defines a central passageway 136 therethrough in which an electrical power supply cord is received. Similarly, the passageway 136, which is formed by radially inwardly-facing surfaces of the spiral body 134, is preferably formed with minimal draft so that the power supply cord 38 fits snugly therein.

Figure 9:
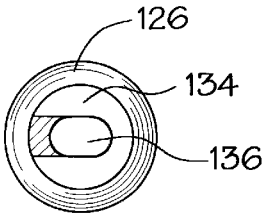
FIG. 9 is a transverse sectional view of the cord guard of FIG. 7 taken along line 9—9 thereof.
Figure 10:
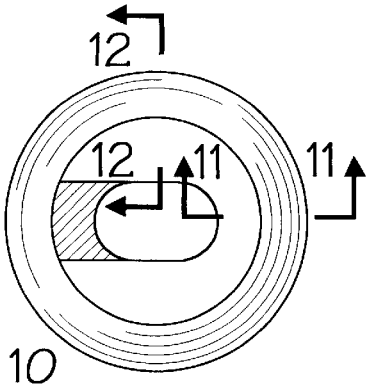
FIG. 10 is a transverse sectional view similar to FIG. 9 but on a larger scale.
Figure 11:
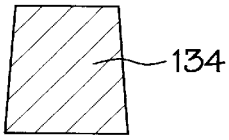
FIG. 11 is an enlarged circumferential sectional view of the cord guard of FIG. 7 taken along line 11—11 of FIG. 10.
Figure 12:
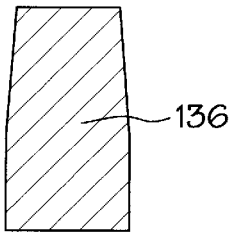
FIG. 12 is an enlarged circumferential sectional view of the cord guard of FIG. 7 taken along line 12—12 of FIG. 10.

Because the central passageway 136 is generally oval or elliptical in transverse cross-section, as shown in FIG. 9, the helical cross-section, i.e. a circumferential cross-section taken along the helical or spiral path of the body 134, varies around the circumference of the body 134. With reference to FIGS. 10 and 11, the helical cross-section of the spiral body 134 at its sides, i.e. the 3 o'clock and 9 o'clock positions as viewed in FIG. 10, is generally in the shape of a trapezoid. With reference to FIGS. 10 and 11, the helical cross-section of the spiral body 134 at its top and bottom, i.e the 12 o'clock and 6 o'clock positions as viewed in FIG. 10, is generally in the shape of an elongated trapezoid (i.e. a trapezoid having a rectangle extending from its base). As evident, the helical cross-sectional shape of the spiral body 134 changes or grows from the trapezoid of FIG. 11 to the elongated trapezoid of FIG. 12 as one travels along the spiral body from the 3 o'clock or 9 o'clock position to the 6 o'clock or 12 o'clock position, thereby creating the oval or elliptical shape of the passageway 136. The particular trapezoidal shapes illustrated in FIGS. 11 and 12 have been found suitable to provide the cord guard 120 with the desired rigidity or bending characteristics.

The cord guard 120, including its spiral body 134, may be molded in one piece from material such as the materials listed above for the preferred embodiment using the above-described dual slide molding technique or any other suitable molding techniques which provides the minimal draft of the central passageway 136. However, the cord guard 120 is preferably molded from nylon.

Although the presently preferred embodiments of this invention have been described, it will be understood that within the purview of the invention various changes may be made within the scope of the following claims.

Having thus described my invention, I claim:

1. A combined electrical power supply cord and cord guard therefor for use in an electrical appliance, comprising:

an electrical power supply cord having a predetermined transverse cross-sectional size and shape;

a flexible strain relief sleeve having a central passageway through which a portion of said electrical power supply cord extends, said passageway having a substantially uniform transverse cross-sectional size and shape along its length which is substantially the same as the transverse cross-sectional size and shape of said portion of said electrical power supply cord, whereby said portion of the power supply cord fits snugly within the central passageway; and an outwardly-flared bell at one end of said strain relief sleeve open to the central passageway therein.

2. The combination of claim 1 wherein said strain relief sleeve comprises a tubular body having a plurality of mutually-parallel, equally-spaced V-shaped grooves extending circumferentially therearound, each of said grooves extending without interruption around the entire circumference of said tubular body.

3. The combination of claim 2 wherein said tubular body is formed from a matrix of elastomeric material.

4. The combination of claim 1 wherein said central passageway is generally elliptical in transverse cross-section and has major and minor transverse axes, and wherein said bell flares to a greater extent along an axis parallel to the minor transverse axis of said central passageway than along an axis parallel to the major transverse axis of said central passageway.

5. The combination of claim 1 wherein said strain relief sleeve comprises an open cylindrical spiral body having a uniform outside diameter along its length, said central passageway being formed by radially-inwardly facing surfaces of said spiral body.

6. The combination of claim 5 wherein said spiral body is formed from a matrix of elastomeric material.

7. The combination of claim 5 wherein said spiral body is integrally-formed with said bell.

8. In a cord guard for an electrical power supply cord provided to reduce strain on said power supply cord, said cord guard comprising a unitary flexible sleeve having a central passageway formed therein adapted to receive said electrical power supply cord, the improvement wherein said sleeve comprises a tubular body having a plurality of parallel, equally-spaced V-shaped grooves extending circumferentially therearound, each of said grooves extending without interruption around the entire circumference of said tubular body.

9. The improvement of claim 8 wherein said electrical power cord has a cross-sectional size and shape, and wherein said central passageway has a substantially uniform transverse cross-sectional size and shape along its length which is the same as the cross-sectional size and shape of said electrical power cord to thereby snugly receive said electrical power supply cord.

10. The improvement of claim 9 further comprising an outwardly-flared bell at one end of said tubular body.

11. The improvement of claim 9 wherein said central passageway is generally elliptical in transverse cross-section.

12. The improvement of claim 8 further comprising an outwardly-flared bell at one end of said tubular body.

13. The improvement of claim 12 wherein said central passageway is generally elliptical in transverse cross-section.

14. The improvement of claim 8 wherein said tubular body has a generally elliptical transverse cross-sectional shape.

15. The improvement of claim 14 wherein said central passageway is generally elliptical in transverse cross-section.

16. The improvement of claim 8 wherein said passageway is defined by a continuously smooth inner wall of said tubular body.

17. The improvement of claim 8 wherein said V-shaped grooves are defined by a plurality of outwardly-projecting, mutually-parallel, equally-spaced ridges extending circumferentially around said tubular body, each of said ridges being generally triangular in circumferential cross-section and extending without interruption around the entire circumference of said tubular body.

18. The improvement of claim 17 wherein each of said ridges has a rounded peak.

19. The improvement of claim 11 further comprising an outwardly-flared bell at one end of said tubular body, wherein said central passageway has major and minor transverse axes, and wherein said bell flares to a greater extent along an axis parallel to the minor transverse axis of said passageway than along an axis parallel to the major transverse axis of said passageway.

20. The improvement of claim 13 wherein said central passageway has major and minor transverse axes, and wherein said bell flares to a greater extent along an axis parallel to the minor transverse axis of said passageway than along an axis parallel to the major transverse axis of said passageway.

21. In a cord guard for an electrical power supply cord, said cord guard comprising a unitary flexible sleeve having a central passageway formed therein adapted to receive an electrical power supply cord, the improvement wherein said sleeve comprises an open spiral body and wherein said central passageway is formed by radially-inwardly facing surfaces of said spiral body and is elliptical in transverse cross-sectional shape.

22. The improvement of claim 21 wherein portions of said spiral body are trapezoidal in cross-sectional shape taken helically along the length thereof, and wherein other portions of said spiral body have a cross-sectional shape taken helically along the length thereof in the form of a rectangle joined along its upper margin to the lower margin of a trapezoid.

23. The improvement of claim 21 further comprising an outwardly-flared bell at one end of said spiral body.

24. The improvement of claim 23 wherein said central passageway has major and minor transverse axes, and wherein said bell flares to a greater extent along an axis parallel to the minor transverse axis of said passageway than along an axis parallel to the major transverse axis of said passageway.

25. In a cord guard for an electrical power supply cord, said cord guard comprising a unitary flexible sleeve having a central passageway formed therein adapted to receive an electrical power supply cord, the improvement wherein said sleeve comprises an open spiral body, said central passageway being formed by radially-inwardly facing surfaces of said spiral body, and further comprising an outwardly-flared bell at one end of said spiral body.

26. The improvement of claim 25 wherein said spiral body has a uniform outside diameter along its length.

* * * * *

UNITED STATES PATENT AND TRADEMARK OFFICE

CERTIFICATE OF CORRECTION

PATENT NO. : 5,823,817

DATED : October 20, 1998

INVENTOR(S) : Michael L. Pyle

It is certified that error appears in the above-identified patent and that said Letters Patent is hereby corrected as shown below:

Column 4, line 30, after "guard" insert --20.--; and line 53, change "85+5" to --85 +/- 5--

Signed and Sealed this

Fourteenth Day of March, 2000

*Attest:*

*Attesting Officer*

Q. TODD DICKINSON

*Commissioner of Patents and Trademarks*